United States Patent [19]

Mabuchi et al.

[11] Patent Number: 4,566,442

[45] Date of Patent: Jan. 28, 1986

[54] MASSAGER

[75] Inventors: Kenichi Mabuchi, Matsudo; Masao Yagi, Kashiwa, both of Japan

[73] Assignee: Bio Mobuchi Co. Ltd., Japan

[21] Appl. No.: 486,101

[22] Filed: Apr. 18, 1983

[30] Foreign Application Priority Data

Apr. 28, 1982 [JP] Japan ..... 57-71724
May 24, 1982 [JP] Japan ..... 57-87599

[51] Int. Cl.[4] ..... A61H 7/00
[52] U.S. Cl. ..... 128/52; 128/55
[58] Field of Search ..... 128/24.1, 24.2, 51–56; 81/463, 464; 273/69; 124/21, 22, 26, 27, 37

[56] References Cited

U.S. PATENT DOCUMENTS

| | | | |
|---|---|---|---|
| 798,825 | 9/1905 | Peterson | 124/26 X |
| 1,123,639 | 1/1915 | Wise | 128/52 |
| 1,124,726 | 1/1915 | Gray | 124/27 |
| 1,796,444 | 3/1931 | Delléra et al. | 128/55 |
| 4,088,128 | 5/1978 | Mabuchi | 128/52 |

FOREIGN PATENT DOCUMENTS

| | | | |
|---|---|---|---|
| 58280 | 3/1916 | Fed. Rep. of Germany | 128/24.1 |
| 321925 | 1/1903 | France | 128/54 |
| 736275 | 11/1932 | France | 128/54 |
| 1099524 | 9/1955 | France | 273/69 |

*Primary Examiner*—Richard J. Apley
*Assistant Examiner*—David J. Brown
*Attorney, Agent, or Firm*—McGlew and Tuttle

[57] ABSTRACT

A massager has a device body, a drive unit housed in the device body, a connecting arm driven by the drive unit, an actuator operating in conjunction with the connecting arm, a space guide, an energy storage part consisting of compression springs for storing energy when compressed by the connecting arm, an energy releasing mechanism for rapidly releasing the stored energy, and an adjusting mechanism for adjusting the energy stored in the compression springs, the actuator being adapted to pat the skin surface plural pieces of the compression springs are connected in series so as to make the patting intensity adjustable discontinuously and to make the overall dimensions smaller. Also, a mechanism for feeding warm air onto the skin surface being patted as necessary in the aforementioned massager is disclosed.

7 Claims, 6 Drawing Figures

MASSAGER

BACKGROUND OF THE INVENTION

This invention relates generally to a massager, and more specifically to a massager in which the skin surface is patted repeatedly by repeatedly driving an actuator and using the resiliency of a spring, wherein the patting intensity can be easily adjusted to a substantial degree, and the massaging effect is made more effective by feeding warm air as necessary onto the skin surface being patted.

DESCRIPTION OF THE PRIOR ART

Patting or flipping the face with fingertips is a practice heretofore widely used as a face-lifting massage.

Various massagers utilizing electric energy are known, most of which are of a type giving vibrations to the skin surface. These massagers involving depression of the skin surface or application of circular motion to the skin surface may expand the skin surface, resulting in loosening of the skin or wrinkles in extreme cases. Furthermore, massagers of the conventional type have too narrow a massaging intensity adjusting range to meet the need for adjusting the massaging intensity in accordance with the skin portions being massaged. In this connection, there has been a strong need for developing a massager capable of patting the skin surface, adjusting the massaging intensity according to the portions being massaged to the optimum level, and warming the skin surface being massaged to ensure more effective massaging.

SUMMARY OF THE INVENTION

It is the primary object of this invention to provide a massager capable of repeatedly giving massaging action onto a given portion of the skin surface so that patting action can be applied to the back or shoulder of a patient.

It is another object of this invention to provide a massager in which a space is maintained between a device body and the skin surface being massaged by means of a space guide, and a plate member and a cushioning member attached to an actuator are constructed so as to slightly protrude from the end face of the space guide to give patting or flipping action onto the skin surface.

It is a further object of this invention to provide a massager in which compression springs are constructed so as to permit the springs to be preloaded and to make the amount of preloading adjustable, whereby permitting the patting intensity to be adjusted.

It is a further object of this invention to provide a massager in which two compression springs arranged in series are constructed so as to prevent any one of the two springs from being compressed beyond a predetermined distance, whereby permitting the range of preloading to be minimized and the adjustment range of the patting intensity to be increased.

It is a further object of this invention to provide a massager in which patting action is repeatedly given to a given portion of the skin surface, and at the same time warm air is fed to the skin portion being patted so as to make massaging more effective.

Other and further objects of this invention will become apparent from the following description of embodiments with reference to the accompanying drawings.

DETAILED DESCRIPTION OF THE EMBODIMENTS

Figure 1:
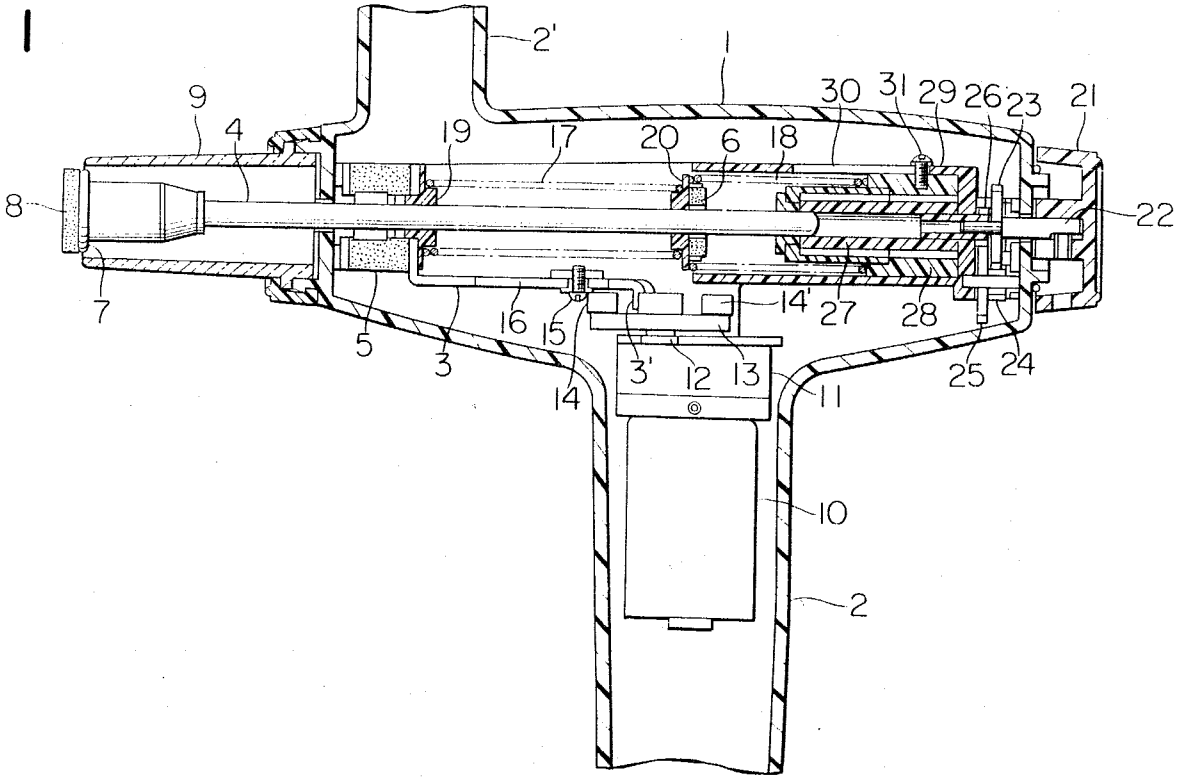
FIG. 1 is a cross sectional side view of a massager embodying this invention.

In the drawings, reference numeral 1 refers to a device body; 2 and 2' to handles; 3 to a connecting arm; 3' to a hook integrally formed with said connecting arm 3; 4 to an actuator; 5 and 6 to cushioning rings; 7 to a plate member mounted on said actuator 4; 8 to a cushioning member mounted on said plate member 7; 9 to a space guide; 10 to a motor; 11 to a reducing gear, or reducer; 12 to a drive shaft; 13 to a revolving disc for driving said connecting arm 3; 14 and 14' to rollers rotatably supported with respect to said revolving disc; 15 to an arm guide pin; 16 to an arm guide groove slidably fitted to said connecting arm 3 with respect to said arm guide pin 15 for preventing unwanted vibration of said connecting arm 3 when driving said actuator 4; 17 and 18 to springs; 19 to a spring seat fixedly fitted to said actuator 4 and supporting said spring 17; 20 to an intermediate spring seat slidably fitted to said actuator 4 and supporting said springs 17 and 18; 21 to a spring compression adjusting knob; 22 to an adjusting knob shaft; 23 through 26 to gears; 27 to a spring compression adjusting screw; 28 to a spring compressing portion; 29 to a hollow cylinder incorporating said spring compressing portion 28; 30 to a guide groove provided on said cylinder 29 for preventing the rotation of said spring compressing portion 28 in a slidable fashion within said guide groove 30; 31 to a screw threaded to portion 28 and riding in groove 30; 32 to a fan; 33 to a mounting plate for mounting a drive unit, etc. on said device body 1; 34 to a warm air outlet provided on said space guide 9; 35 to a warm air deflector provided on said space guide 9; 36 to a heater; 37 to a heater support; 38 to a heater mounting plate; 39 and 40 to power feed wires; and 41 to an air intake, respectively.

Figure 2:
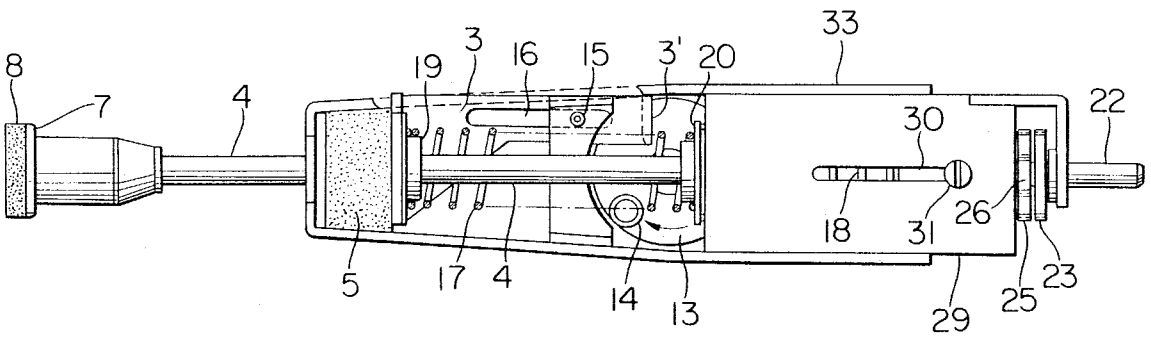
FIG. 2 is a plan view of the embodiment shown in FIG. 1.

The device body 1 has the handles 2 and 2', constructed in a pistol shape so as to be held by a single hand. In the handle provided is the motor 10 which causes the drive shaft 12 to rotate via the reducer 11. The revolving disc 13 is fixedly fitted to the drive shaft 12 and caused to rotate as the drive shaft 12 rotates. The rollers 14 and 14' are rotatably provided on the revolving disc 13 and alternately engaged with the hook 3' integrally formed with the connecting arm 3. Another end of the connecting arm 3 is fixedly fitted to the actuator 4. The spring seat 19 is fixed to said actuator 4 and the springs 17 and 18 are arranged in series between said spring seat 19 and the spring compressing portion 28, which will be described later, via the intermediate spring seat 20 slidably supported by said actuator 4. Consequently, as said revolving disc 13 rotates, causing said roller 14 or 14' to engage with said hook 3', said actuator 4 moves backward (in the rightward direction facing to FIGS. 1 and 2) and compresses said springs 17 and 18. When said roller 14 or 14' is disengaged from said hook 3' integrally formed with the connecting arm 3, said springs 17 and 18 extend rapidly, causing said actuator 4 to rapidly move forward (in the leftward direction facing to FIGS. 1 and 2). As a result, the plate member 7 and the cushioning member 8 protrude slightly from the tip of the space guide 9 as shown in FIG. 1. At this time, the cushioning ring 5 plays a cushioning role for the device body 1. The fact that the rollers 14 and 14' are rotatably supported with respect to said revolving disc 13 enables said rollers 14 and 14' to easily disengage from said hook 3'.

In this way, as the motor 10 rotates, causing said actuator 4 to repeatedly reciprocate, the cushioning member 8 repeatedly pats the skin surface in contact with the tip of the space guide 9. The patting intensity corresponds to the magnitude of the compression force required for compressing said springs 17 and 18 to their maximum limit (the force required for compressing said springs, in other words, repulsion force). For example, the state shown in FIG. 1, that is, the state where said springs 17 and 18 are not preloaded, said required compression force is unilaterally determined by the travelling distance L of said connecting arm 3 (said travelling distance is in turn determined by the distance between the roller 14 or 14' and the driving shaft 12). As described at the beginning of this specification, however, the intensity of patting action should preferably be adjustable. This invention, however, has such a construction that the patting intensity can be adjusted by preloading said springs 17 and 18, as will be described later, and making the amount of preloading adjustable while maintaining the travelling distance L of said connecting arm 3 constant (due to the difficulty in terms of mechanical construction of making said travelling distance L adjustable). That is, the amount of preloading is adjusted by rotating the spring compression adjusting knob 21. The mechanism for adjusting the amount of preloading according to this invention will be described in the following, referring to FIG. 3.

Figure 3:
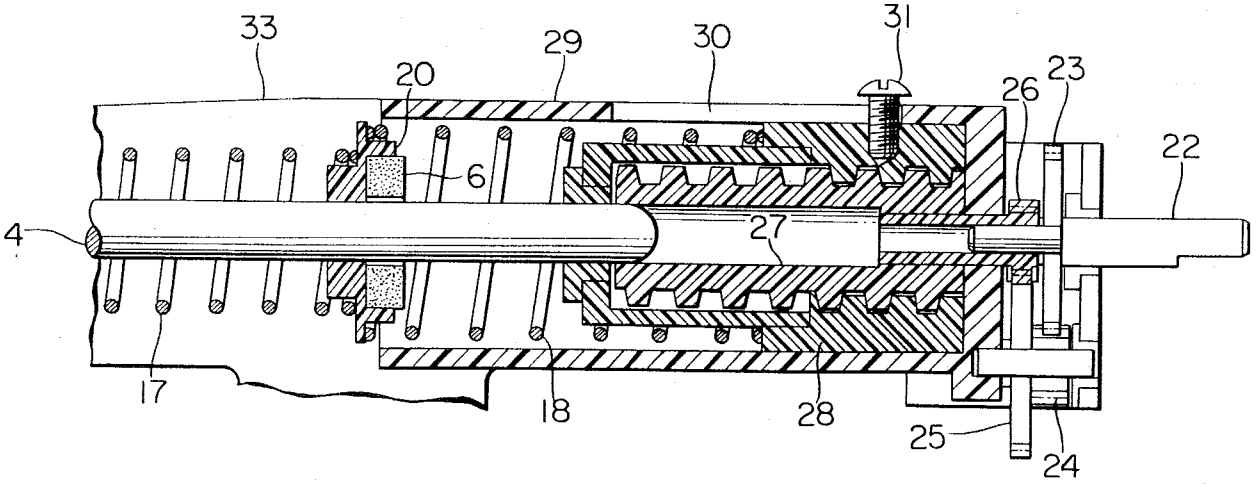
FIG. 3 is an enlarged view of assistance in explaining an adjusting means for adjusting the amount of energy accumulation in the energy storage means in the embodiment shown in FIG. 1.

In FIG. 3, the spring compression adjusting screw 27 fixed to the gear 26 is caused to rotate via the adjusting knob shaft 22, the gears 23 through 26 by rotating said spring compression adjusting knob 21 (not shown in FIG. 3). The rotation of the spring compression adjusting screw 27 causes the spring compressing portion 28 having a threaded portion screwed to said adjusting screw 27 to move in such a direction as to compress the spring 18 (in the leftward direction facing to FIG. 3). The gears 23 through 26 are for amplifying the rotating angle of the spring compression adjusting knob shaft 22 to transmit to the spring compression adjusting screw 27.

In this way, when said spring compressing portion 28 is caused to move to compress the spring 18, the spring 17 is also compressed since the intermediate spring seat 20 is slidably supported by the actuator 4. That is, what is called the amount of preloading is applied to said springs 17 and 18 by adjusting the travelling distance of said spring compressing portion 28. Since the aforementioned patting intensity is determined by the total spring constant k of said springs 17 and 18, said amount of preloading and the travelling distance L of said connecting arm 3, it is possible to make said amount of preloading, that is, the travelling distance of said spring compressing portion 28 adjustable and to adjust spring compression to a desired value by selecting said total spring constant k and the travelling distance L of said connecting arm 3. Said total spring constant k can be obtained from the following expression.

$$1/k = 1/k1 + 1/k2 \quad (1)$$

(where k1: spring constant of spring 17, k2: spring constant of spring 18).

As described above, the patting intensity in the massager of this invention can be adjusted to a desired range by appropriately selecting the travelling distance L of said connecting arm 3 and the total spring constant k, that is, the spring constants k1 and k2 of the springs 17 and 18. In the following, description will be given about the correlationship among said travelling distance L, said spring constants k, k1 and k2, and the amount of preloading when said patting intensity is set to a desired adjustment range in the embodiment shown in FIGS. 1 through 3.

Now assume that the adjustable range of total compression force of said springs 17 and 18 required for adjusting the patting intensity to a desired range is approx. 1.2 kg to 5 kg. In this case, the lower limit of said required compression force is a value at the amount of preloading of zero, which is determined solely by said travelling distance L and said total spring constant k. Assuming that the total spring constant k is set to 0.06 kg/mm with the travelling distance L being 20 mm, the spring constant k1 of the spring 17 being 1.5 kg/mm and the spring constant k2 of the spring 18 being 1.0 kg/mm, the required compression force of the springs 17 and 18 can be expressed by an alternate long and short dash line A in FIG. 4. That is, said required compression force becomes 1.2 kg (shown by point a in the figure) at the amount of preloading of zero. Thus, in order to obtain the maximum required compression force value of 5 kg, it is necessary to set the amount of preloading at approx. 60.3 mm. In other words, by making the amount of preloading adjustable from zero to 60.3 mm, said required compression force can be adjusted within a desired range of approx. 1.2 through 5 kg.

Setting the adjustable range of the amount of preloading to as large as approx. 60.3 mm, however, may increase not only the size of the mechanism for adjusting the amount of preloading but also the rotating angle of the spring compression adjusting knob 21. For this reason, springs having a total spring constant k of 0.1 kg/mm has to be used in order to limit the amount of preloading to a range of zero to approx. 30 mm while maintaining the maximum required compression force at approx. 5 kg. In this case, the lower limit of said required compression force, becomes equal to 2 kg at the amount of preloading of zero, as shown by an alternate long and two short dashes line B in FIG. 4, failing to meet the condition that the minimum required compression force be 1.2 kg.

To overcome this problem, the present invention has such a construction that when the total compression of the springs 17 and 18 reaches a predetermined value, either of said springs 17 and 18 is prevented from being compressed any longer. With this arrangement, the required compression force based on the total spring constant of said springs 17 and 18 can be obtained until the total displacement of said springs 17 and 18 reaches a predetermined value, and thereafter the required compression force based on the spring constant of any one of the springs 17 and 18 can be obtained. This arrangement will be described in detail, referring to the embodiment of this invention shown in FIGS. 1 through 3. The embodiment shown in FIGS. 1 through 3 has such a construction that the tip of the spring compressing portion 28 depresses the intermediate spring seat 20 when said total displacement reaches a predetermined value, that is, the spring 18 is not compressed any longer after the total displacement exceeds the predetermined value. In the embodiment shown in FIGS. 1 through 3, the correlationship between the amount of preloading and the required compression force can be expressed by a continuous line C connecting points a, b and c in FIG. 4 where it is assumed that the travelling distance L of the connecting arm 3 is 20 mm, as described above, and the spring constant k1 of the spring 17 and the spring constant k2 of the spring 18 are set so as to obtain a total spring constant k of 0.06 kg/mm, and that the distance between the tip of said spring compressing portion 28 (that is, its left-most end) and the intermediate spring seat 20 is set at 16 mm when the amount of preloading is zero. In other words, by adjusting the amount of preloading within a range of zero to 30 mm, the required compression force can be adjusted to a desired level between 1.2 kg and 5 kg. What distance between the tip of said spring compressing portion 28 and the intermediate spring seat 20 is required to obtain the desired range of required compression force at the amount of preloading of zero depends on the travelling distance L of said connecting arm 3, the spring constant k1 of the spring 17 and the spring constant k2 of the spring 18.

Figure 4:
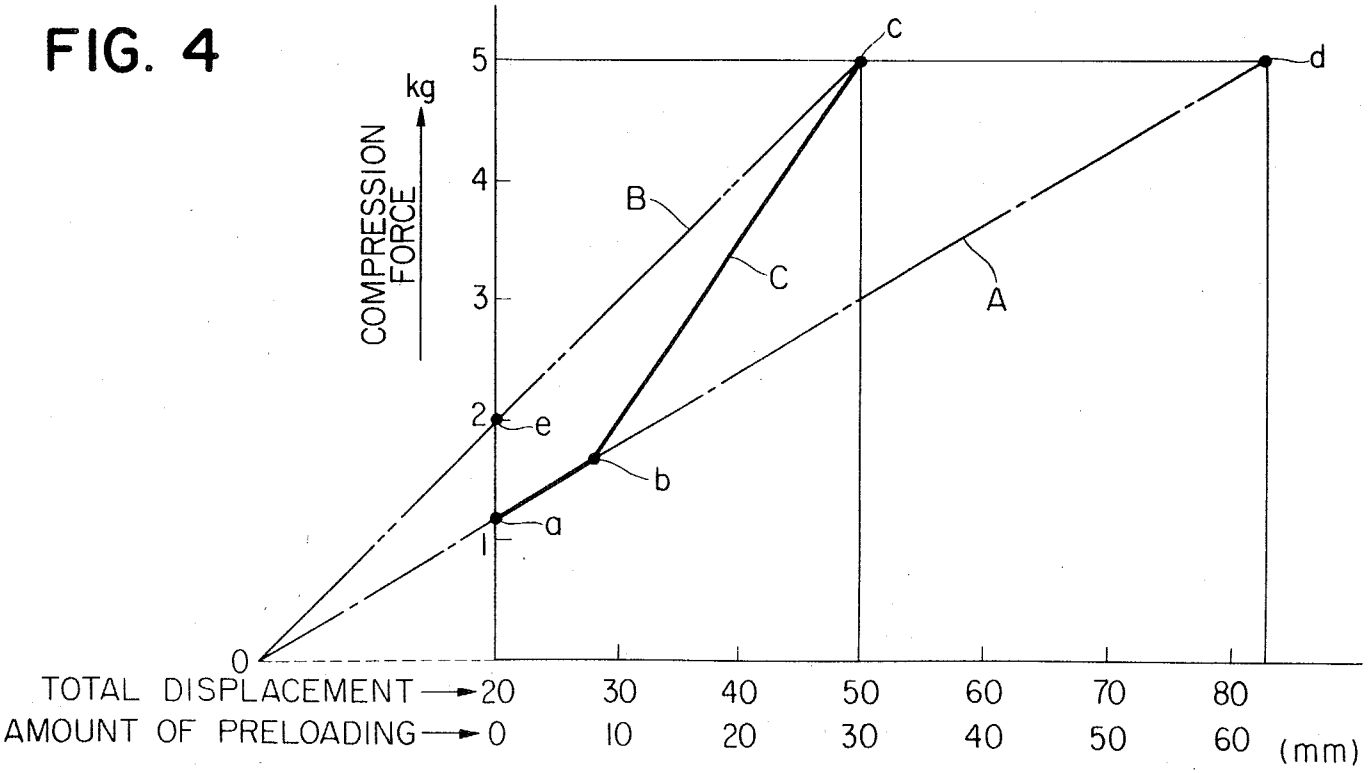
FIG. 4 is a diagram of assistance in explaining the relationship between the amount of energy accumulation and the amount of adjustment by said adjusting means in this invention.

Within the range between points b and c in the continuous line C in FIG. 4, said intermediate spring seat 20 hits against the tip of the spring compressing portion 28 during the reciprocating movement of said connecting arm 3 or said actuator 4. The shock caused by this collision, however, can be reduced by the cushioning ring 6.

Figure 5:
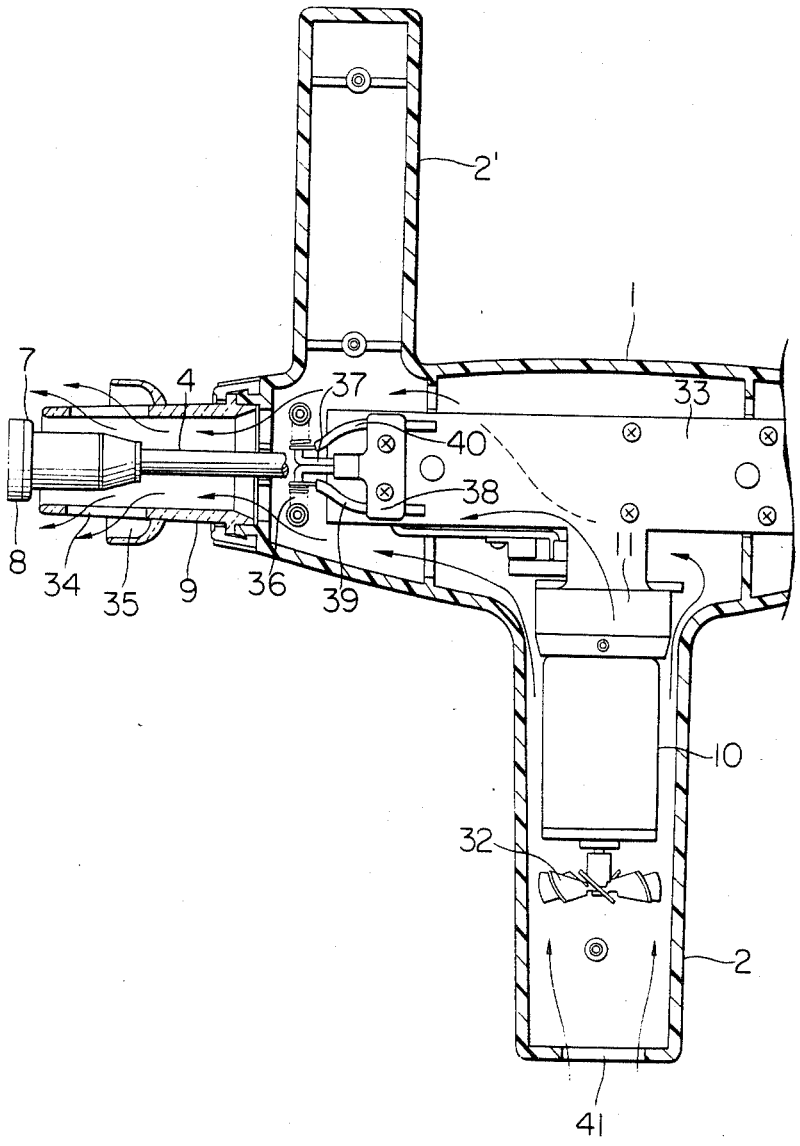
FIG. 5 is a cross sectional side view of another embodiment of this invention.
Figure 6:
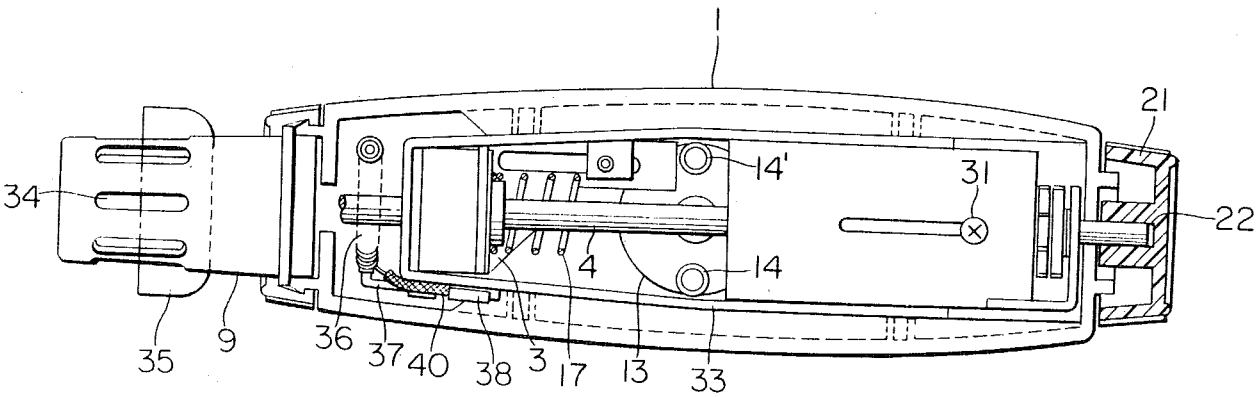
FIG. 6 is a plan view of the embodiment shown in FIG. 5.

In FIG. 5 illustrating another embodiment of this invention, the motor 10 starts running, causing the actuator 4 to repeatedly reciprocate to bring the massager to a state ready for use, as described with reference to FIG. 1. At the same time, the power is fed to the heater 36 via the power feed wires 39 and 40. As shown in FIGS. 5 and 6, the heater 36 is of a ring shape with the actuator 4 passing through the hole thereof. The heater 36 is fixedly mounted on the mounting plate 33 of the device body 1 by means of the heater support 37 and the heater mounting plate 38. As the motor starts running, the fan 32 connected directly to the motor 10 starts operating. Thus, the fan 32 takes in the air from the air intake 41 provided on the handle 2 shown in FIG. 5. The air taken in through the air intake 41 rises in the handle 2 along the side wall of the motor 10 and heated by the heater 36 provided in the device body 1. The heated air is passed through the space guide 9 and discharged from the warm air outlet 34 provided on the space guide 9, as shown by arrows in FIG. 5. As is evident from FIGS. 5 and 6, a plurality of the warm air outlet 34 are exposed on the outer wall of the space guide 9 near the tip of the space guide 9. The warm air deflector 35 is provided on the space guide 9 in such a manner that the warm air deflector 35 half covers the warm air outlets 34 and yet is opened toward the tip of the space guide 9. Thus, the warm air discharged from said warm air outlets 34 is directed toward the tip of the space guide 9 by said warm air deflector 35 to warm the skin surface being massaged in front of the tip of the space guide 9.

As described above, this invention makes it possible to provide a massager in which the intensity of patting the skin surface can be easily changed by using the resiliency of springs, preloading the springs so as to permit a displacement to the springs and adjusting the amount of preloading. This invention also makes it possible to provide a massager in which the adjustment range of said preloading can be reduced and the adjustment range of said patting intensity can be increased by using two springs in series and constructing the springs so that any one of the springs is not compressed beyond a predetermined limit during said preloading. Furthermore, this invention makes it possible to provide a massager in which the motor driving the massaging mechanism also drives the fan to take the air in the device body, the air thus taken in is heated by the heater provided in the air passage and discharged from the warm air outlets provided on the space guide and directed toward the skin surface being massaged by the warm air deflector to ensure effective massaging. The space guide is for properly maintaining the relative position of the skin surface and the device body, and has heretofore been formed into a hollow cylindrical shape. In this invention, warm air outlets are provided on the outer wall of the space guide of a hollow cylindrical shape to discharge warm air without sacrificing the mechanical strength of the hollow cylinder.

What is claimed is:

1. A massager having a device body, a drive unit housed in said device body, a connecting arm driven by said drive unit, energy storage means comprising at least two compression springs connected in series for storing energy when compressed by said connecting arm driven by said drive unit, energy releasing means for rapidly releasing the energy stored in said energy storage means, an actuator driven by said energy storage means and said energy releasing means, a plate member mounted on said actuator, a space guide mounted on said device body for defining an area through which said plate member can travel, and adjusting means for adjusting the amount of energy stored in said energy storage means, characterized in that said adjusting means is constructed so as to adjust the amount of energy stored in said energy storage means and limit the amount of energy stored in at least one of said springs to a predetermined value, said plate member being caused to move to a location apart from a skin surface essentially in contact with said space guide in a state where energy is stored in said energy storage means, and said plate member hits against said skin surface when the energy thus stored is released by said energy releasing means, whereby patting action is repeatedly effected by said plate member onto the skin surface, said actuator being constructed of a retractable rod member, said adjusting means having a spring compression portion, an intermediate spring seat movable in said body and slidably supported by said rod-shaped actuator and connecting said at least two compression springs in series; one end of said compression springs connected in series being supported by said connecting arm and the other end therof by said spring compressing portion; and said compression springs being adapted to be compressed between said connecting arm and said spring compressing portion of said adjusting means when said connecting arm is driven.

2. A massager as set forth in claim 1 wherein said adjusting knob has a spring compression adjusting means, a spring compression adjusting screw which is caused to rotate by the operation of said spring compression adjusting knob, and said spring compressing portion screwed to said spring compression adjusting screw, and is constructed so that said spring compression adjusting screw is caused to rotate by the operation of said spring compression adjusting knob to cause said spring compressing portion to move in the direction of travel of said actuator, whereby the amount of energy stored in said energy storage means is adjusted.

3. A massager as set forth in claim 2, wherein said spring compressing portion is constructed of an annular piece formed concentrically with said rod-shaped actuator and has an end facing said intermediate spring seat, and when said spring compressing portion is caused to move beyond said predetermined value by said spring compression adjusting screw, said end of said spring compressing portion contacts and causes said intermediate spring seat to move while keeping in contact therewith.

4. A massager as set forth in claim 3, wherein said spring compressing portion has a support for supporting one of said compression springs; said support being disposed at a rear of said spring compressing portion away from said end therof.

5. A massager as set forth in claim 1, wherein said spring compression portion has an end facing said intermediate spring seat and also carries a further spring seat, one of said at least two springs being engaged between said intermediate spring seat and said further spring seat, said adjusting means including means for displacing said spring compression portion to a position engaging said end of said spring compression portion with said intermediate spring seat which corresponds to a limitation in the amount of energy stored in said at least one said spring, further movement of said spring compression portion causing simultaneous movement of said spring compression portion and said intermediate spring seat and no further compression of said at least one spring.

6. A massager as set forth in claim 1 wherein said device body incorporates an electric heater, and said drive unit is adapted to drive a fan so that warm air is discharged by said fan from said space guide onto said skin surface while said drive unit at least keeps driving said connecting arm.

7. A massager as set forth in claim 6 wherein said space guide has a cylindrical peripheral wall and a plurality of warm air outlets provided on the cylindrical peripheral wall thereof and a warm air deflector half covering the outer circumference of said warm air outlets for deflecting said warm air toward said skin surface in contact with said space guide.

* * * * *